US012708226B1

(12) United States Patent
Sehestedt

(10) Patent No.: US 12,708,226 B1
(45) Date of Patent: Aug. 18, 2026

(54) SPACERS TO MOUNT DIGITAL POSTERS TO BRACKETS

(71) Applicant: Lee Michael Sehestedt, Coral Gables, FL (US)

(72) Inventor: Lee Michael Sehestedt, Coral Gables, FL (US)

( * ) Notice: Subject to any disclaimer, the term of this patent is extended or adjusted under 35 U.S.C. 154(b) by 0 days.

(21) Appl. No.: 18/816,058

(22) Filed: Aug. 27, 2024

(51) Int. Cl.
*A47G 1/16* (2006.01)

(52) U.S. Cl.
CPC ..... *A47G 1/1606* (2013.01)

(58) Field of Classification Search
CPC ..... A47G 1/1606
USPC ..... 248/475.1
See application file for complete search history.

(56) References Cited

U.S. PATENT DOCUMENTS 3,012,750 A * 12/1961 Schermerhorn, Jr. . A47B 57/56 248/230.9
4,074,888 A * 2/1978 Garner ..... A47G 1/0655 411/510
5,356,106 A 10/1994 Trotta et al.
5,428,913 A * 7/1995 Hillstrom ..... G09F 7/18 40/604
7,963,011 B2 * 6/2011 Lottini ..... F16B 5/0664 24/691
8,356,777 B2 * 1/2013 Miles ..... F16L 3/133 248/292.12
9,038,971 B1 * 5/2015 Guthrie ..... F16M 11/40 361/679.56
9,370,267 B2 * 6/2016 Greve ..... A47G 1/24
10,145,503 B2 * 12/2018 Feldman ..... F16M 11/00
10,687,638 B1 * 6/2020 Ghofranian ..... A47G 1/205
11,434,952 B2 * 9/2022 Spino ..... A47F 7/0246
11,697,942 B2 * 7/2023 Pytlewski ..... E04F 21/22 52/126.1
2005/0218287 A1 * 10/2005 Strobel ..... A47G 1/205 248/495
2006/0185319 A1 * 8/2006 Kufner ..... E04F 21/0092 52/749.11
2010/0096511 A1 * 4/2010 Olver ..... H02G 3/32 248/65
2011/0147554 A1 * 6/2011 Liao ..... F16B 2/12 248/226.11
2012/0241567 A1 * 9/2012 Gillespie-Brown ..... F16M 11/041 248/122.1
2013/0221189 A1 * 8/2013 Kubin ..... F16M 13/04 248/683
2016/0095422 A1 * 4/2016 Ralph ..... F16B 2/12 24/136 R
2018/0252336 A1 * 9/2018 Erkelens ..... F16L 3/137
2021/0062966 A1 * 3/2021 Woolman ..... A47H 1/104
2021/0108742 A1 * 4/2021 Varale ..... F16L 3/105
2022/0263304 A1 * 8/2022 Bell ..... H02G 3/263
(Continued)

*Primary Examiner* — Muhammad Ijaz
(74) *Attorney, Agent, or Firm* — Sanchelima & Associates, P.A.; Christian Sanchelima; Jesus Sanchelima

(57) ABSTRACT

Spacers to mount digital posters to brackets including a body assembly, a fastening assembly, and a fastener assembly. The body assembly includes a body made of a rubber plastic. The fastening assembly includes at least one opening. The at least one opening goes through the body. The fastener assembly includes at least one fastener. The at least one fastener goes through the at least one opening. The at least one fastener attached the body assembly between a digital poster and a bracket.

1 Claim, 13 Drawing Sheets

(56) References Cited

U.S. PATENT DOCUMENTS

2023/0296857 A1* 9/2023 Zujewski ..... H02G 15/007
385/136

* cited by examiner

SPACERS TO MOUNT DIGITAL POSTERS TO BRACKETS

BACKGROUND OF THE INVENTION

1. Field of the Invention

The present invention relates to spacers to mount digital posters to brackets and, more particularly, spacers to mount digital posters to brackets to reduce surface contact issues between the spacer and the digital poster mounting components.

2. Description of the Related Art

Several designs for spacers have been designed in the past. None of them, however, include slots and holes to accommodate different mounting methods such as zip ties, ratchet straps, drywall anchors, or masonry screws for additional mounting security.

Applicant believes that a related reference corresponds to U.S. Pat. No. 5,356,106 issued for a universal mounting bracket assembly for the use with a variety of display fixtures having slots for hanging brackets or displays including a hook member for insertion into a slot of the display fixture and adjustable leveling means for proper alignment. Applicant believes that another related reference corresponds to U.S. Pat. No. 7,963,011 issued for a fitting system for securing a panel to a wall or ceiling. None of these references, however, teach of spacers to mount digital posters to brackets including additional holes and slots for using attaching means such as zip ties or ratchet straps.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide spacers to mount digital posters to brackets that includes holes to match the hole patterns on the digital posters mounting brackets allowing proper and secure mounting of digital posters.

It is another object of this invention to provide spacers to mount digital posters to brackets that includes different textures and shapes to accommodate different digital posters.

It is still another object of the present invention to provide spacers to mount digital posters to brackets that protects and provides a versatile mean to mount digital posters to brackets.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
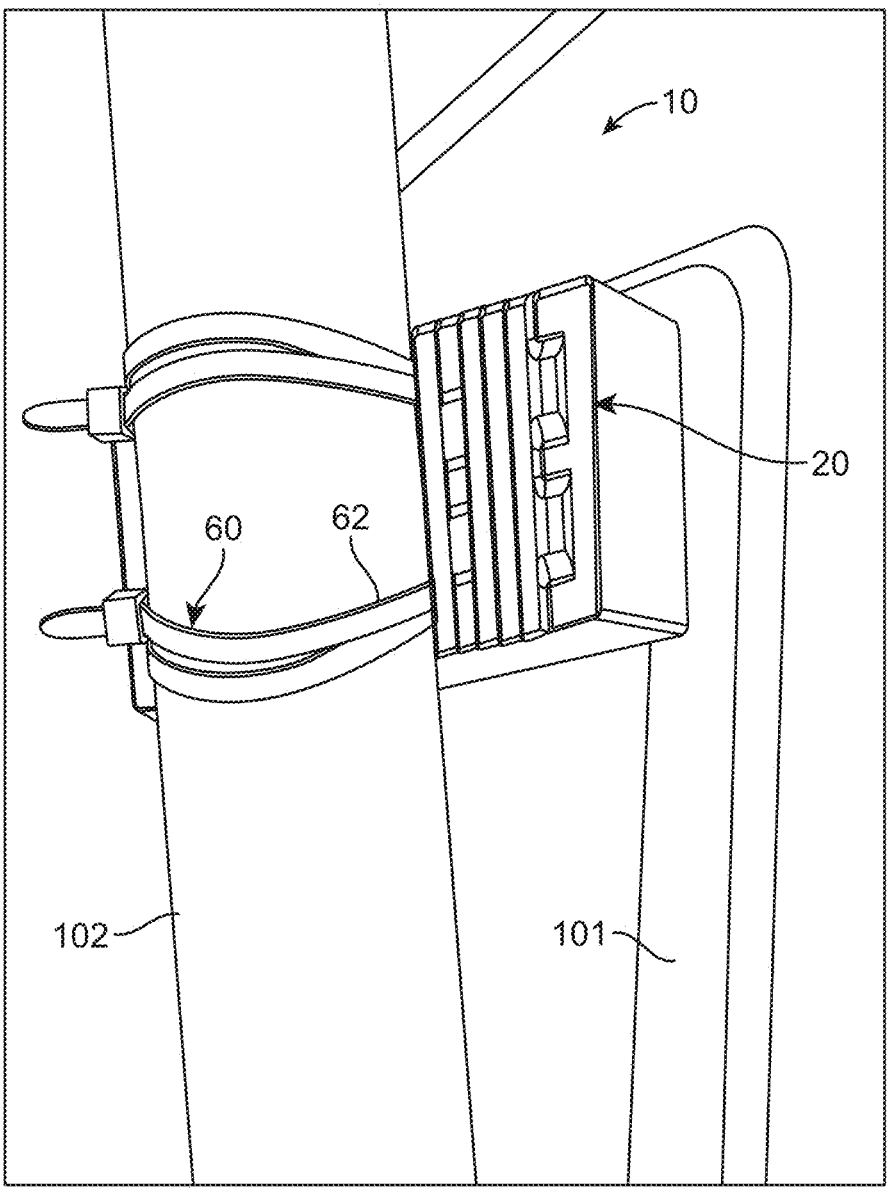
FIG. 1 represents an isometric operational view of a first embodiment of the present invention 10 serving as an spacer between digital poster 101 and support 102.

Referring now to the drawings, where the present invention is generally referred to with numeral 10, it can be observed that it basically includes a body assembly 20 and a fastening assembly 40 It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

As best shown in FIG. 1, the present invention may be used as a spacer between bracket 102 and digital poster 101. The present invention 10 may present different embodiments and variations in shape to adapt to a variety of shapes of brackets 102. The present invention 10 may dampen impacts and permit attachment of the digital poster 101 with the bracket 102.

Figure 2:
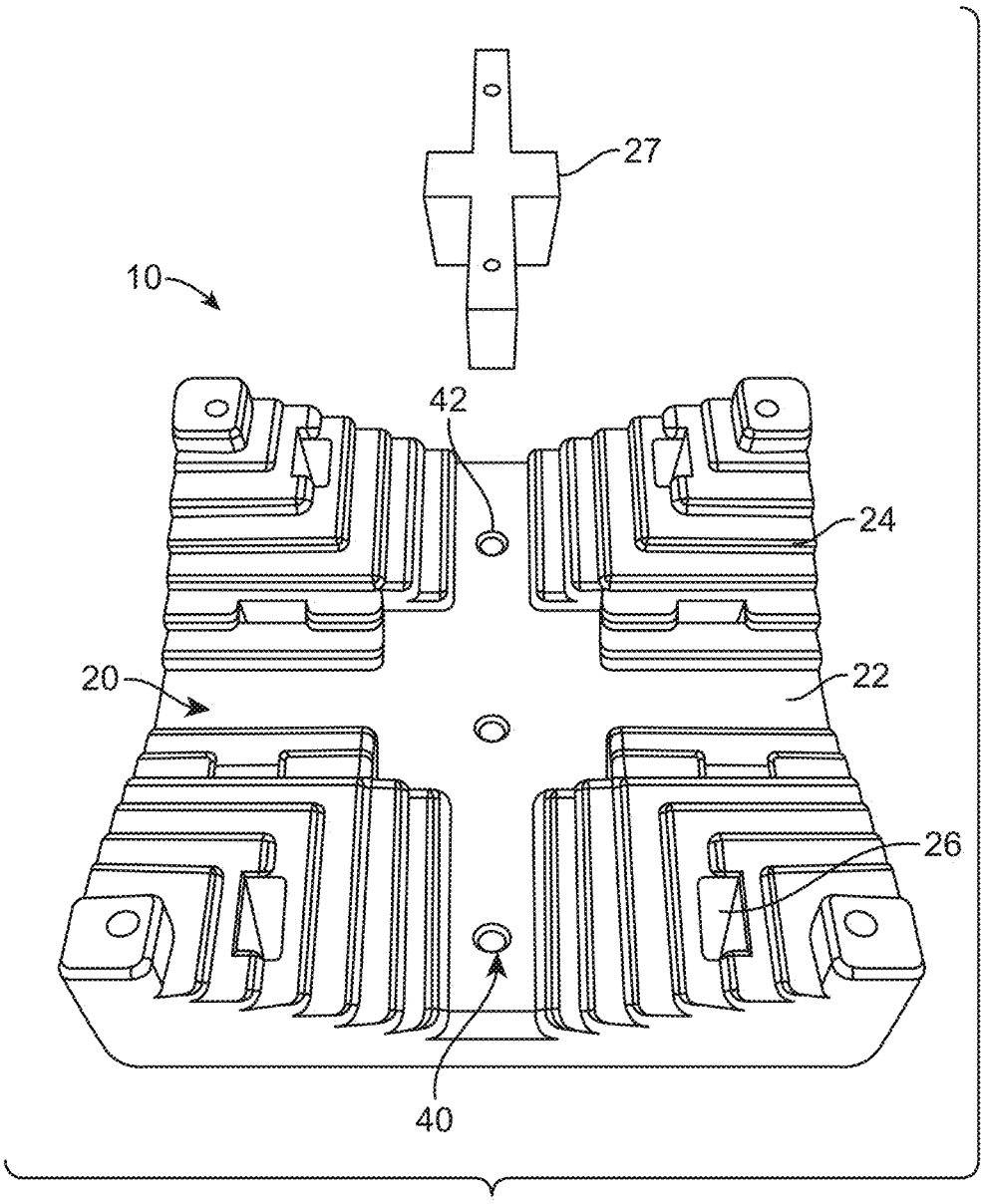
FIG. 2 shows an isometric view of a first embodiment of the present invention 10. The present invention 10 includes a body assembly 20, and a fastening assembly 40.
Figure 3:
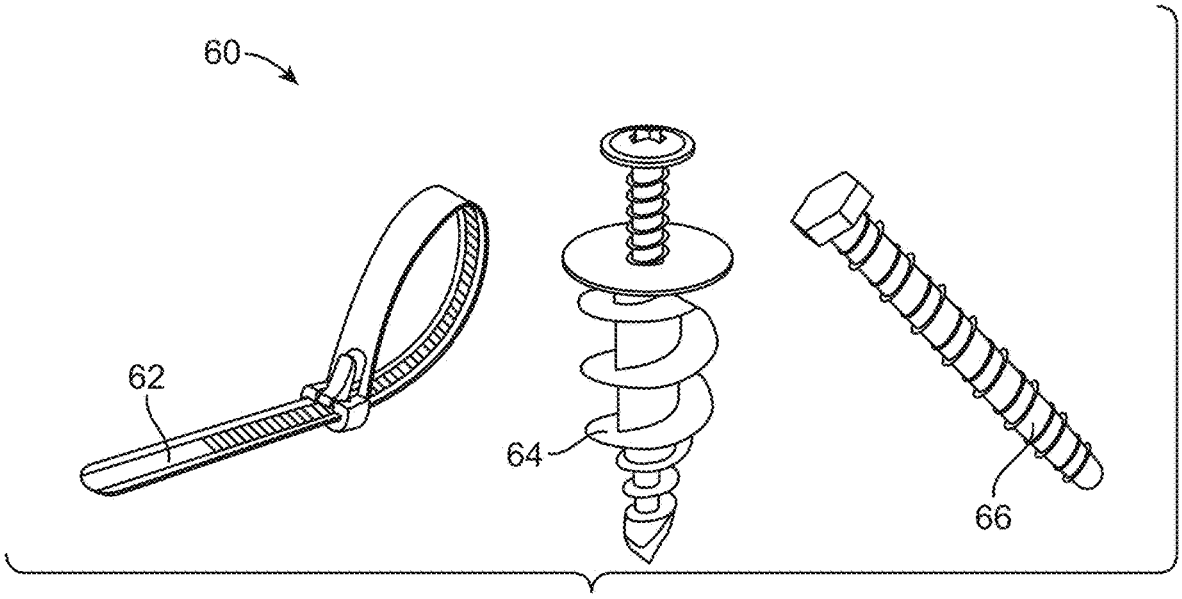
FIG. 3 illustrates different fasteners of a fastener assembly 60.

Referring now to FIG. 2, it can be shown that the body assembly 20 may include a body 22, coupling members 27, protruding portions 24 and receiving openings 26. In one embodiment the body 22 may have a rectangular shape. It also may be suitable for the body 22 to have a triangular shape, an hexagonal shape, or any other suitable shape. In a preferred embodiment the body 22 and the protruding portions 24 may be made of thermoplastic elastomer. It also may be suitable for the body 22 and the protruding portions 24 to be made of polyurethane, polyvinyl chloride, or any other resistant material. In a first embodiment, the protruding portions 24 may be located on each corner of a top end of the body 22. In a preferred embodiment the protruding portions 24 may have a stepped shape increasing from a central portion of the top end of the body 22 to the corners thereof. The protruding portions 24 may be equidistant therebetween defining central channels in the top end of the body 22. In one embodiment the central channels may have a cross shape. The central channels may receive a coupling member 27.

Figure 1A:
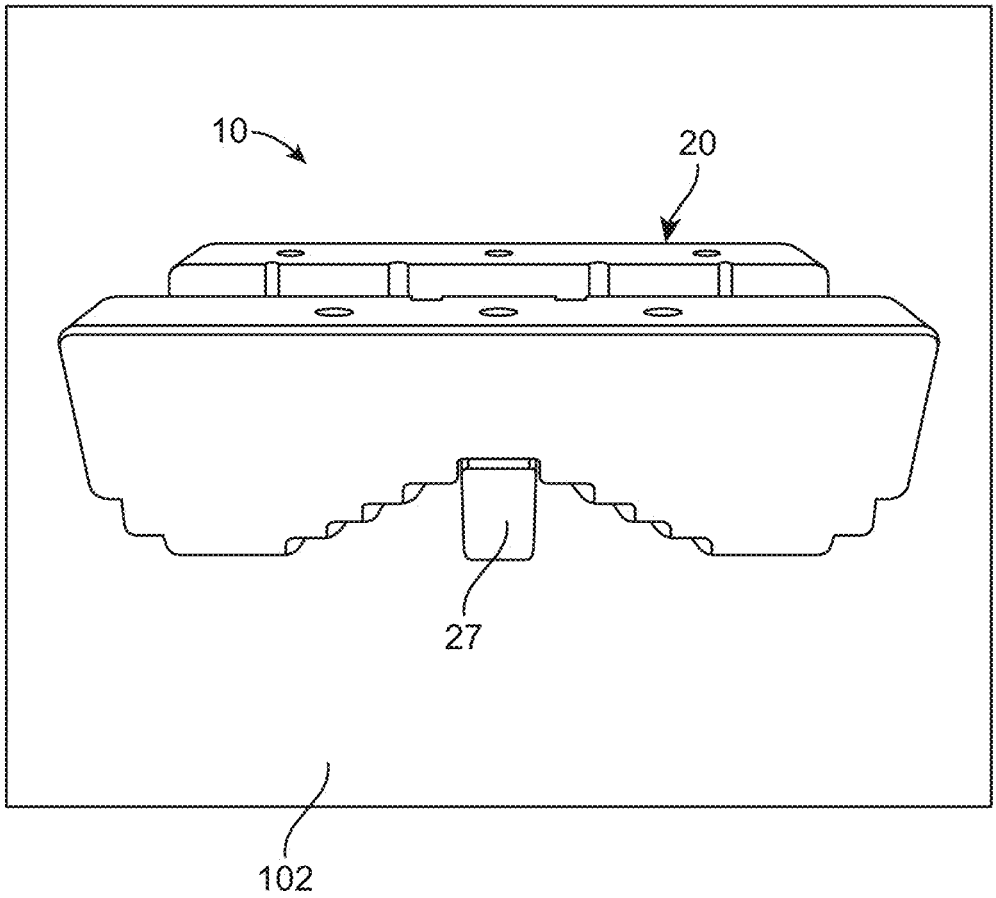
FIG. 1A is a representation of an isometric operational view of a first embodiment of the present invention 10 serving as a spacer between digital poster 101 (not shown in this figure) and bracket 102 having the coupling member 27 to best adapt to bracket 102, where bracket 102, in this exemplary embodiment, is a wall.

The receiving openings 26 may preferably have a rectangular shape. It also may be suitable for the receiving openings 26 to have a circular shape, a triangular shape, or any other suitable shape. In one embodiment the receiving openings 26 may partially go through the body 22. The receiving openings 26 may be equidistantly spaced therebetween. In one embodiment, the receiving openings 26 may be adapted to receive protruding members of brackets 102. In yet another embodiment the receiving openings 26 may transversally go through the body 22. In one embodiment, the coupling members 27 adapt to a shape of the central channels. In one embodiment the coupling members 27 may have a rectangular shape. It also may be suitable for the coupling members 27 to have a triangular shape, a cylindrical shape, or any other suitable shape. The coupling members 27 may be introduced in the central channels to adapt the top surface of the body assembly 20 to brackets 102. The coupling member 27 may be adjusted into central channel of the body 22 to adapt the present invention 10 to predetermined surfaces such as a wall, as best depicted in FIG. 1A. It should be understood that the different embodiments described herein may include alternative embodiments of the coupling member 27 to adapt the present invention to different surfaces.

Figure 4:
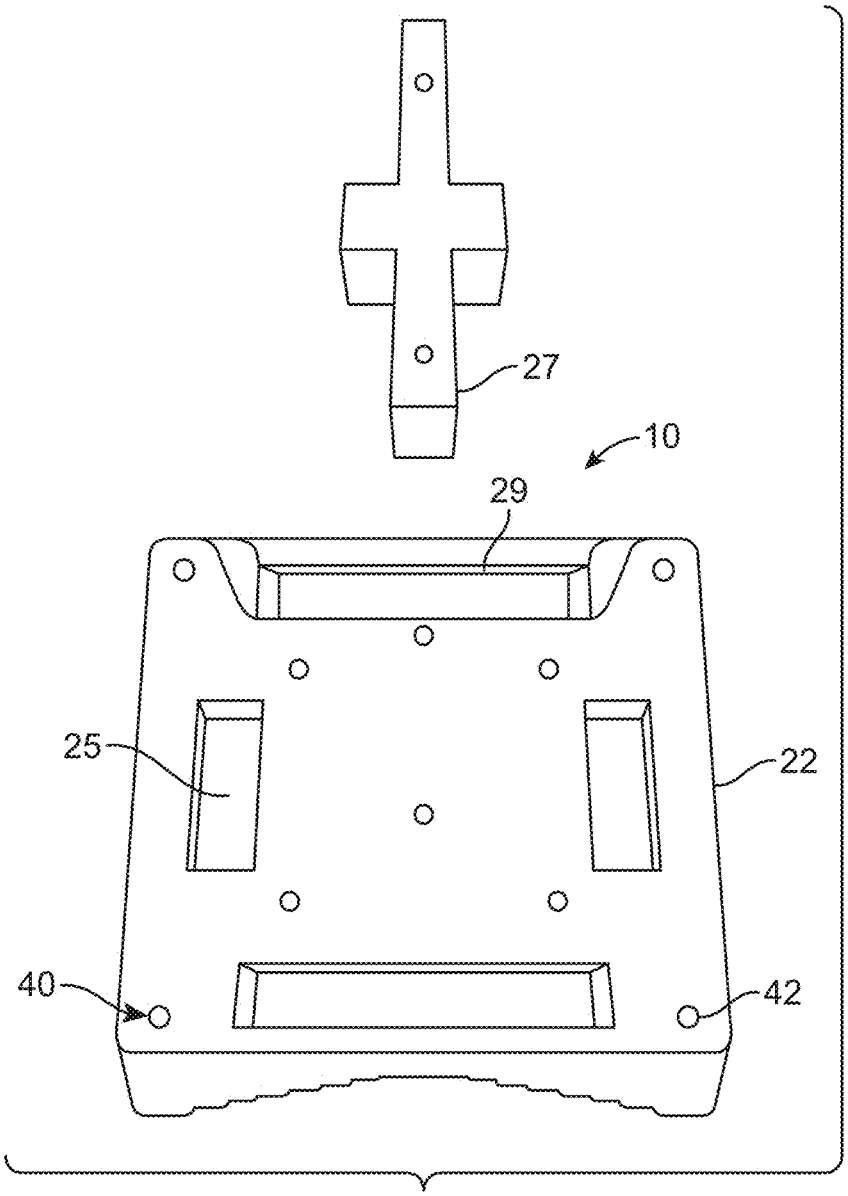
FIG. 4 is a representation of a rear view of a first embodiment of the present invention 10.

Referring now to FIG. 4 it can be shown that a rear wall of the body 22 may include rear openings 25. The rear openings 25 may preferably have a rectangular shape. It also may be suitable for the rear openings 25 to have a circular shape, a triangular shape, or any other suitable shape. The rear openings 25 may receive protruding members of the digital poster 101. It also may be suitable for the rear wall of the body 22 to include adhesive means to be adhered to digital posters 101.

The fastening assembly 40 may include fastening openings 42. The fastening openings 42 may receive one of the fastener assembly 60. The fastener assembly 60 may include but is not limited to zip ties 62, drywall anchors 64, or masonry screws 66. In an exemplary embodiment shown in FIG. 1, the zip ties 62, drywall anchors 64, or masonry screws 66 may go through one of the fastening openings 42 to attach the present invention 10 between the bracket 102 and digital poster 101. It also may be suitable for the zip ties 62, drywall anchors 64, or masonry screws 66 to go through at least one of the receiving openings 26 to attach the present invention 10 between bracket 102 and digital poster 101. It should be understood that fastening openings 42 may vary in size and location to permit zip ties 62, drywall anchors 64, or masonry screws 66 to go through.

Figure 5:
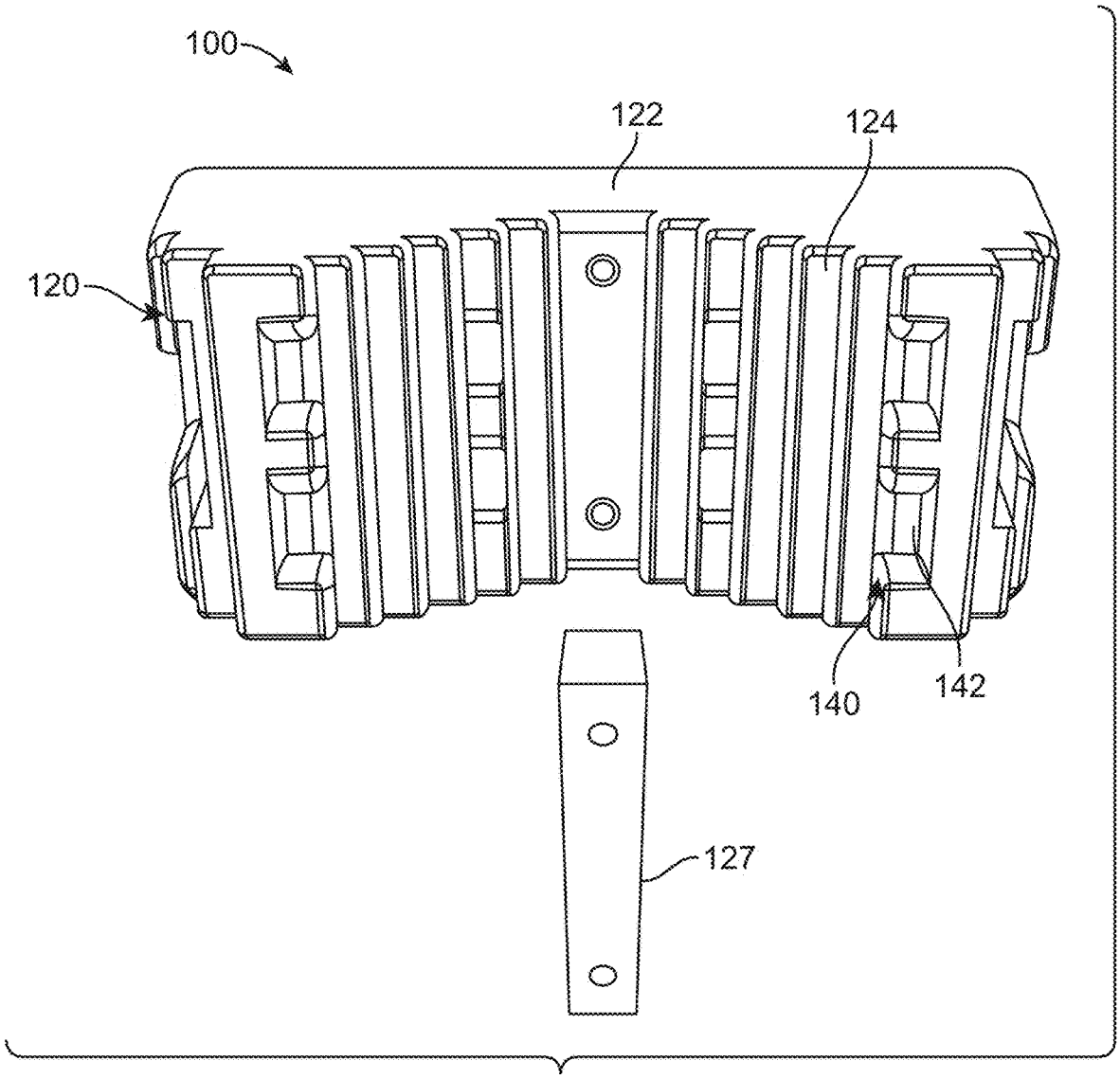
FIG. 5 depicts an isometric view of a second embodiment 100 of the present invention.
Figure 5A:
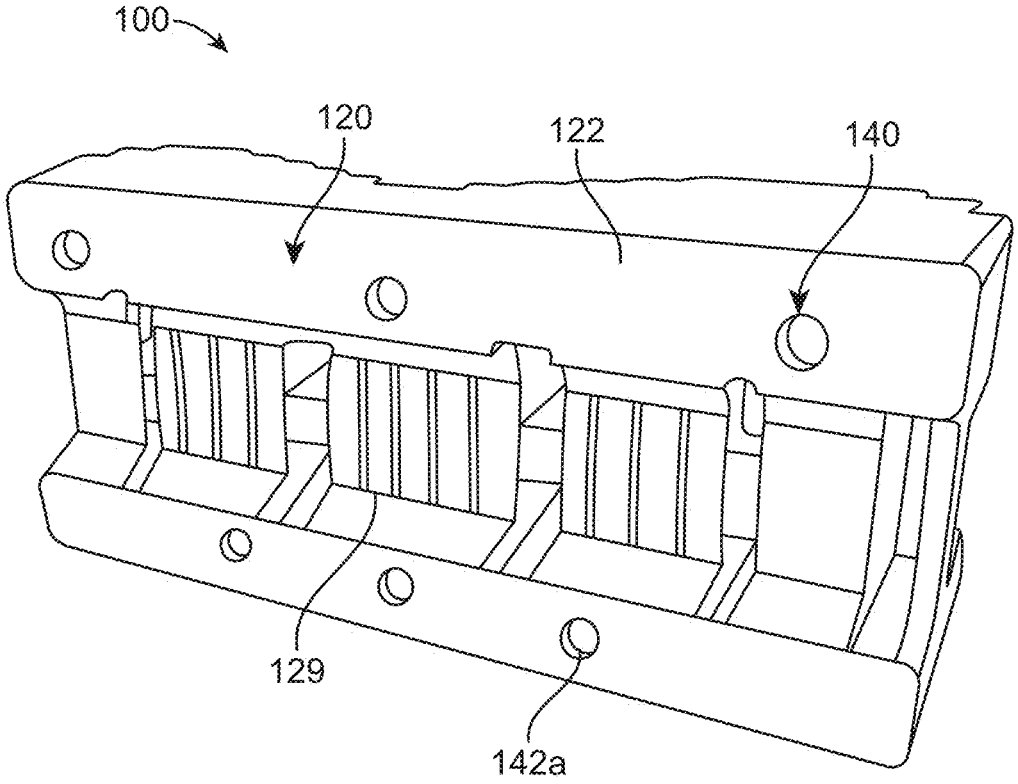
FIG. 5A shows a rear perspective view of the second embodiment 100 of the present invention.

Referring now to FIG. 5 where a second embodiment 100 of the present invention is presented, it can be shown that a first alternative body assembly 120 may include a first alternative body 122, and first alternative protruding members 124. The first alternative body 122 may have a rectangular shape. The first alternative body 122 may be hollow, as best depicted in 5A where a rear opening 129 of the first body is shown. The rear opening 129 may partially extend a rear wall of the body 22 defining a frame portion 142*a*. The first alternative protruding member 124 may have a stepped shape increasing from a central portion of the top end of the alternative body 122 to lateral sides thereof defining a first alternative central channel located at a central portion of the top end of the alternative body 122. The second embodiment may include alternative openings 142. The alternative openings 142 may be adapted to receive one of the zip ties 62, drywall anchors 64, or masonry screws 66 to attach the second embodiment 100 between the digital poster 101 and the bracket 102.

Figure 6:
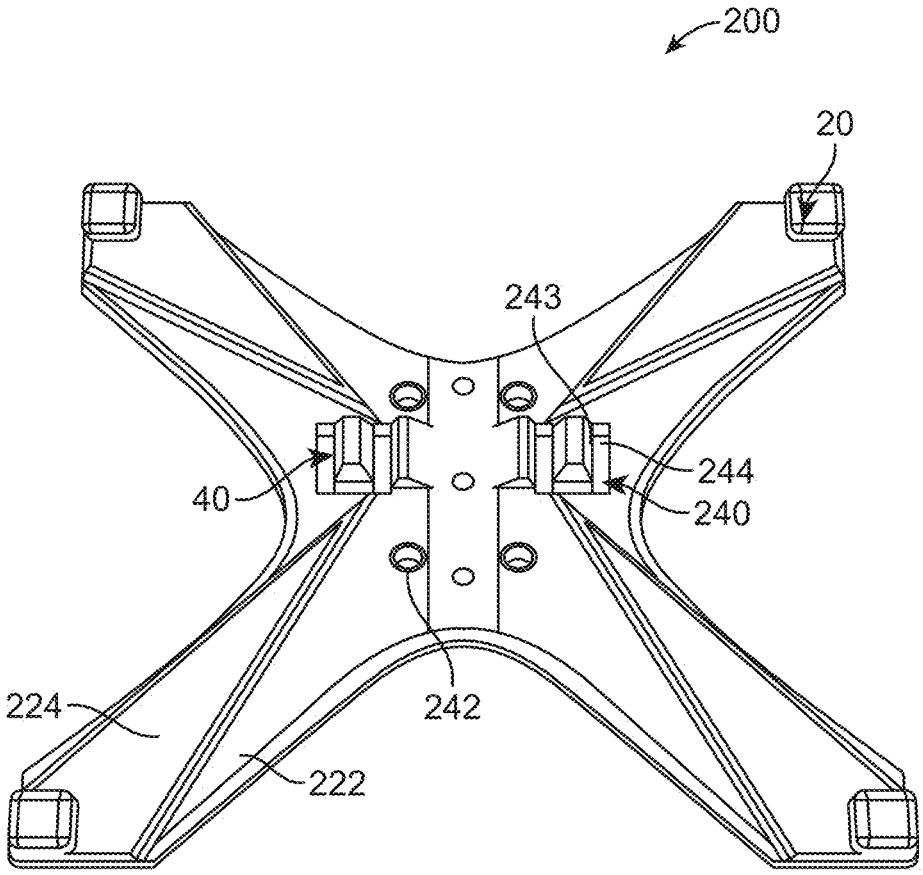
FIG. 6 shows an isometric view of a third embodiment 200 of the present invention.
Figure 6A:
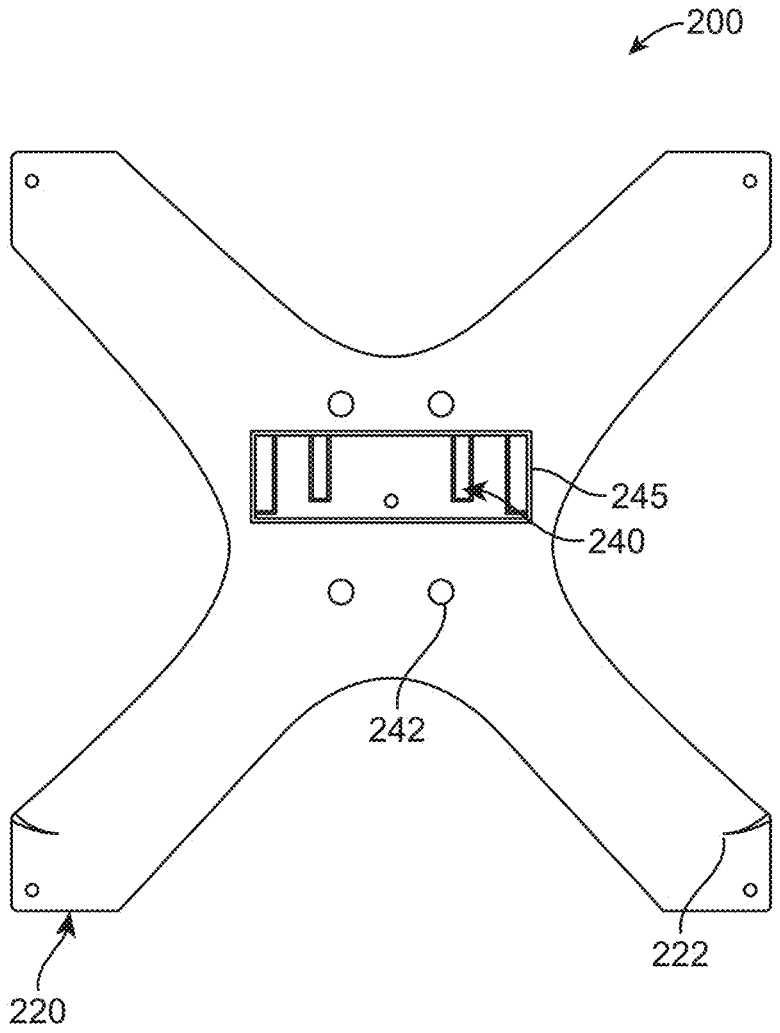
FIG. 6A illustrates a rear view of the third embodiment 200 of the present invention.

Referring now to FIG. 6, it can be shown that a third embodiment 200 may include a third alternative body assembly 220 and a third alternative fastening assembly 240. The third alternative body assembly 220 may include a third alternative body 222, and third protruding members 224. The third alternative fastening assembly 240 may include alternative fastening openings 242, tie openings 244 and stoppers 243. The third alternative body 222 may have four members protruding diagonally from a central portion of the third alternative body 222 defining a "X" shape. The third protruding members 224 may protrude from a top end of the four members. The alternative fastening openings 242 may have a circular shape. It also may be suitable for the alternative fastening openings 242 to have a triangular shape, a rectangular shape, or any other suitable shape. The tie openings 244 may preferably have a rectangular shape. It also may be suitable for the tie openings 244 to have a triangular shape, a circular shape, or any other suitable shape. The tie openings 244 may be located on a central portion of the third alternative body 222. The stoppers 243 may be located on a central portion of each of the tie openings 244. The tie openings 244 may be adapted to have zip ties 62 going therethrough to attach the third embodiment 200 of the present invention between the digital poster 101 and the bracket 102. The alternative fastening openings 242 may have one at least one fastener of the fastener assembly 60 going therethrough. The rear end of the third alternative body 222 may be planar. The rear end of the third alternative body 22 may include an alternative rear opening having a rectangular shape.

Figure 7:
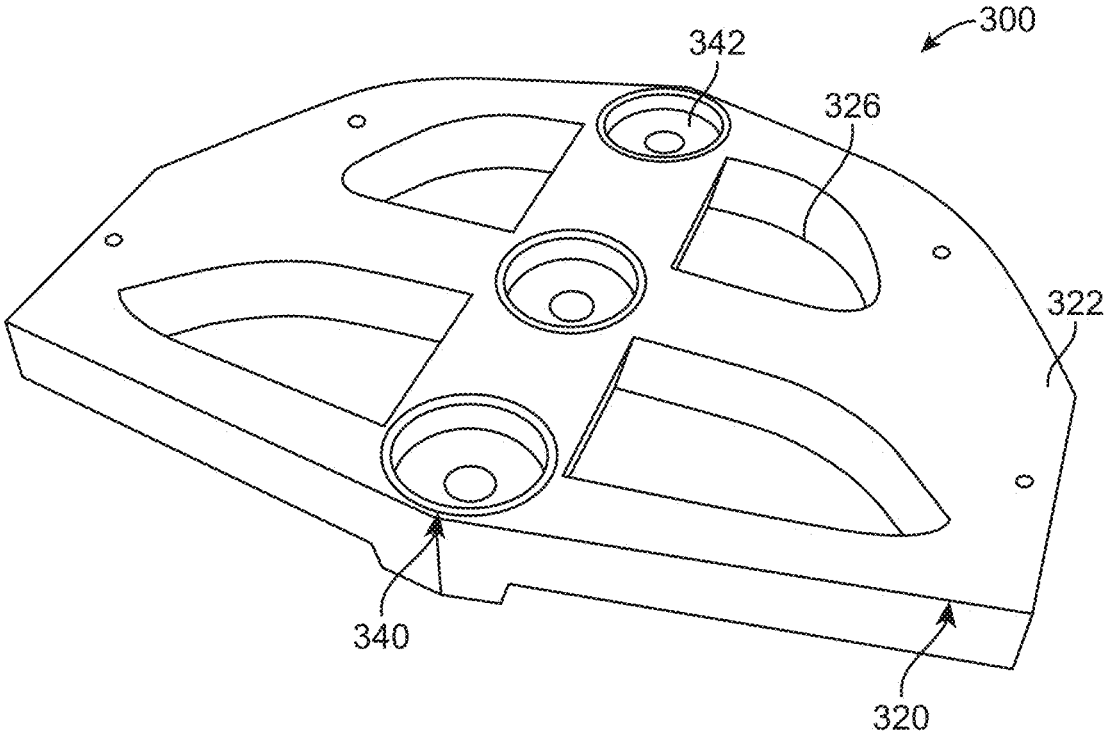
FIG. 7 is an illustration of a fourth embodiment 400 of the present invention.
Figure 7A:
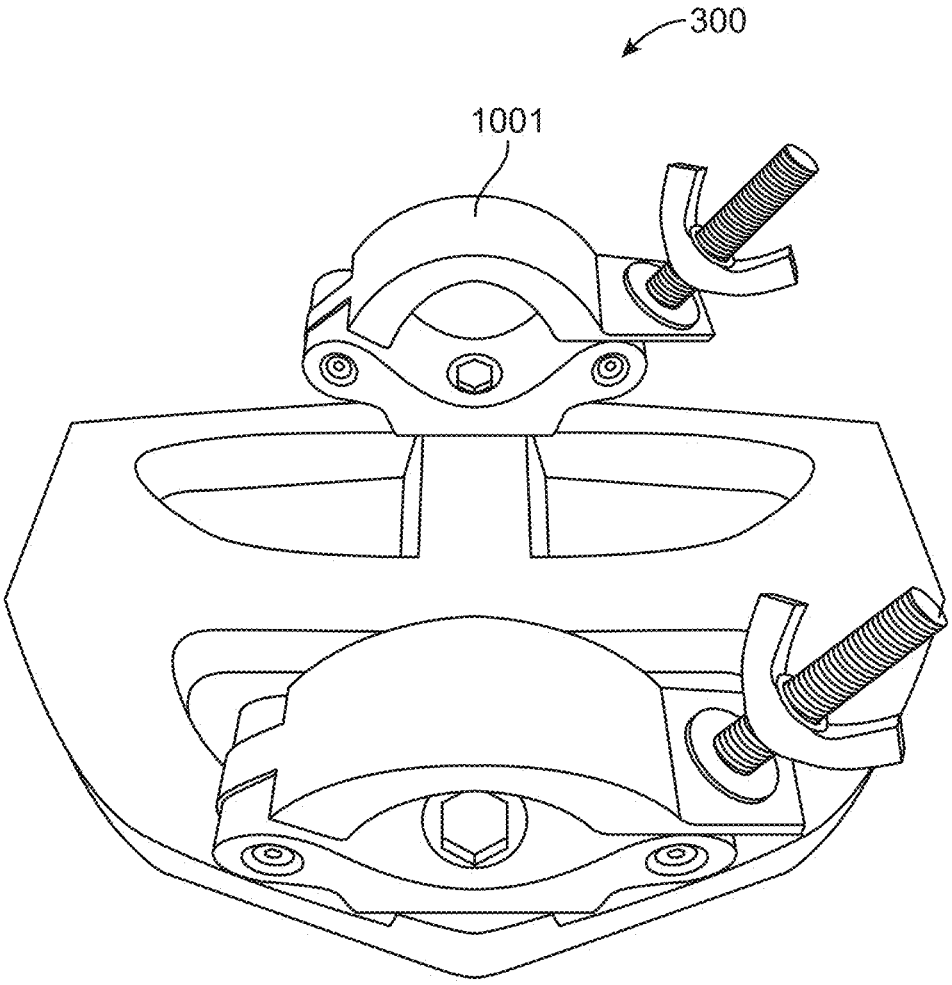
FIG. 7A depicts a rear perspective of the fourth embodiment 300 of the present invention having attaching means 1001.

Referring now to FIG. 7 it can be shown that the present invention 10 may include a fourth embodiment 300. The fourth embodiment 300 may include a fourth alternative body assembly 320 and a fourth alternative fastening assembly 340. The fourth alternative body assembly 320 may include a fourth alternative body 322. In a preferred embodiment, the fourth alternative body 322 may have an oval with a pointed end shape. It also may be suitable for the fourth alternative body 322 to have a rectangular shape, a triangular shape, or any other suitable shape. The fourth alternative fastening assembly 340 may include fourth alternative openings 342 and four structural openings. The fourth alternative openings 342 may have a circular shape to receive at least one fastener of the fastener assembly 60. As best shown in FIG. 7A, the fourth alternative openings 342 may have attaching means 1001 attached thereto. In the fourth embodiment 300 the attaching means are clamps for attaching the present invention 10 to a post. The fourth alternative openings 342 may be threaded. It should be understood that different openings disclosed in the different embodiments may be threaded to receive attaching means 1001. The fourth alternative embodiment 326 may further include open portions 326 to receive straps 62 therethrough.

Figure 8:
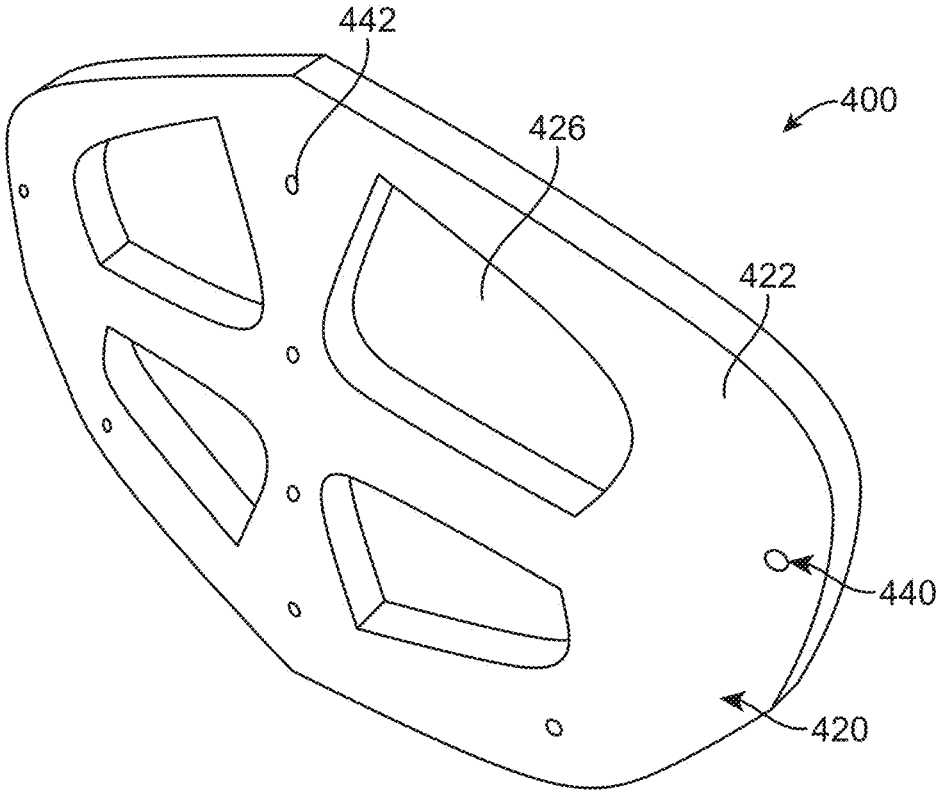
FIG. 8 depicts a fifth embodiment 500 of the present invention.
Figure 8A:
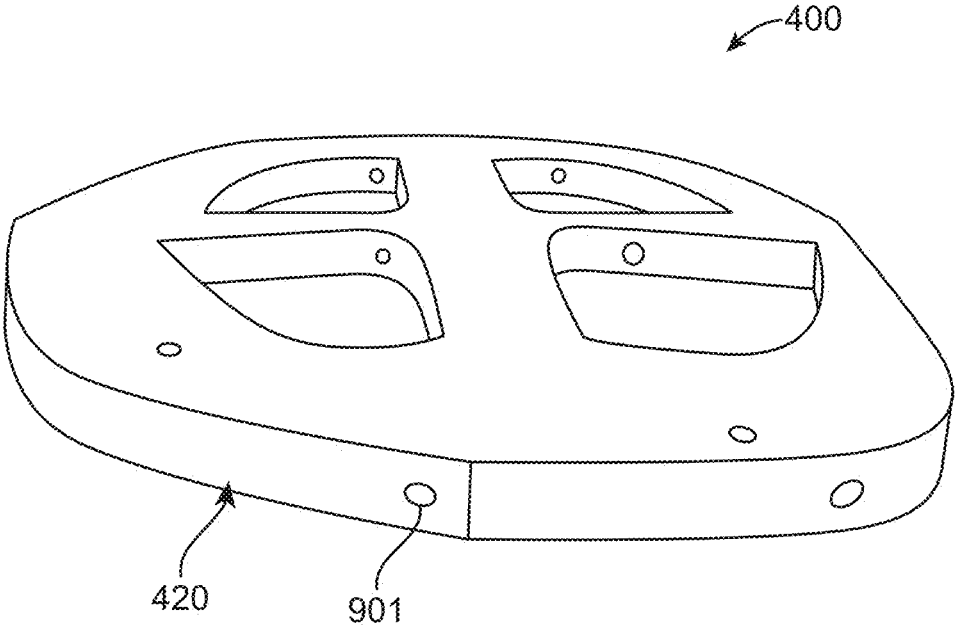
FIG. 8A depicts a right-side perspective view of the fifth embodiment 500 of the present invention including lateral openings 901.

As best depicted in FIG. 8, a fifth embodiment 400 may include fifth alternative body assembly 420 including a fifth alternative body 422 and alternative open portions 426. The alternative open portions 426 may be four equidistant open portions suitable to receive straps 62 therethrough. The fifth alternative body 422 may substantially have an hexagonal shape with rounded corners. It also may be suitable for the fifth alternative body 422 to have a triangular shape, a rectangular shape, or any other suitable shape. The fifth alternative body 422 may include a curvature in a transversal axis thereof. The fifth alternative embodiment 400 may also include a fifth fastening assembly 440 having fifth alternative openings 442. The fifth alternative openings 442 may be equidistantly placed along the fifth alternative body 426. The fifth embodiment 400 of the present invention may include lateral openings 901 to allow wires or ropes (not shown in the drawings) transversally go from right to left to have the present invention in a suspended position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. Spacers to mount digital posters to brackets, consisting of:

a body assembly, wherein said body assembly includes a body and a coupling member, wherein said body is made of thermoplastic elastomer, wherein said body has a rectangular shape, wherein said body has protruding portions, said protruding portions have a stepped shape increasing from a central channel formed on a top end of said body to corners or lateral sides thereof, said central channel receives said coupling member, wherein said coupling member has a rectangular shape;

a fastening assembly, wherein said fastening assembly includes an opening, said opening goes through said body; and a fastener assembly including a fastener, wherein said fastener goes through said opening, said fastener attaches said body assembly between a digital poster and a bracket.

* * * * *